United States Patent [19]

Ferguson, Jr. et al.

[11] Patent Number: 4,466,321

[45] Date of Patent: Aug. 21, 1984

[54] SCRAGG MILL

[76] Inventors: John H. Ferguson, Jr.; Richard O. Angle, both of Rocky Mount, Va.

[21] Appl. No.: 402,415

[22] Filed: Jul. 28, 1982

[51] Int. Cl.[3] ..... B27B 7/00; B27B 29/08

[52] U.S. Cl. ..... 83/435.1; 83/437; 83/708; 83/425.2

[58] Field of Search ..... 83/425.2, 425.4, 435.1, 83/437, 708

[56] References Cited

U.S. PATENT DOCUMENTS

| | | | |
|---|---|---|---|
| 106,160 | 8/1870 | Hill | 83/709 |
| 2,673,581 | 3/1954 | Dornath et al. | 83/435.1 |
| 3,747,455 | 7/1973 | Hartzell et al. | 83/435.1 X |
| 3,889,566 | 6/1975 | Hartzell et al. | 83/708 |
| 4,085,638 | 4/1978 | Fifer | 83/71 |

*Primary Examiner*—Donald R. Schran

[57] ABSTRACT

A scragg mill which includes a pair of driven saw blades, a log carriage for conveying a log between the saw blades and a husk frame assembly for supporting the saw blades and a drive source for the saw blade. The husk frame assembly includes a pair of husk frames telescopingly interlocked with each other so as to enable the two saw blades to be shifted relative to each other.

12 Claims, 5 Drawing Figures

SCRAGG MILL

BACKGROUND OF THE INVENTION

The present invention relates to saw mills and, more particularly, to those of the type known as scragg mills, wherein a log is moved between two circular saws so that the log is cut into elongated boards on both sides.

Typical scragg mills can be seen with reference to U.S. Pat. Nos. 2,946,074 and 4,287,798. In such prior art mills, each of the two circular saws is supported, along with its drive motor and a respective conveyor for carrying off boards cut by the particular blade, on individual husk frames which are mounted so as to be movable towards and away from a log carriage. So as to coordinate movement of the husk frames, a sprocket chain or screw-type drive is interconnected between the two husk frames of the husk frame assembly.

Additionally, in view of the act that logs are not usually straight, but rather have a certain degree of bowing to them, before feeding of the log, via the log carrier, to the circular saw blades, it is customary to turn the log, via a log turner, so that the bowing of the log is oriented in a vertical plane. Previously noted U.S. Pat. No. 4,287,798 shows a log turner which is designed to support a log received from a supply of logs, and, while supporting same, turn it into its proper orientation for being transported by the log carriage through the saw blades. However, the turn over device of this patent is designed for use with an overhead log carriage mechanism and is not suitable for use for log carriages which carry the log upon a supporting beam.

Various forms of devices for turning logs that are to be transported upon an underlying log carriage are known; see, for example, U.S. Pat. Nos. 106,160; 424,385; and 3,981,393. However, log turners as shown in these patents do not support the log themselves during the turning operation, thus rendering the turning operation more difficult and time-consuming, particularly when the mill utilizes a spiked-beam type log carrier.

SUMMARY OF THE INVENTION

In view of the foregoing, it is an object of the present invention to provide an improved scragg mill wherein the husk frame assembly is provided with greater stability.

It is a further object of the present invention to provide a saw mill with an improved log turner which will enable quick and easy turning of a log, while being compatible with both overhead and underneath type log carriages.

In accordance with a preferred embodiment of the present invention, the first of these objects is achieved through the creation of a telescoping husk frame assembly wherein the two husk frames are telescopingly interlocked with each other so as to enable the two saw assemblies to be shifted relative to each other in a simple manner by a piston and cylinder unit and a lever arrangement.

Additionally, the preferred embodiment incorporates a log turner which is simple in design and utilizes pairs of live rollers to raise the log above the log carriage and then to rotate it in either direction until it is in the proper position to be sawed. Once properly oriented, these rollers can be lowered so as to let the log down onto the log carriage for a transporting through the saw blades of the mill. The entire log turning mechanism is mounted upon a carriage which can be shifted by a hydraulic cylinder so as to center the assembly longitudinally with respect to any length log to be sawed.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
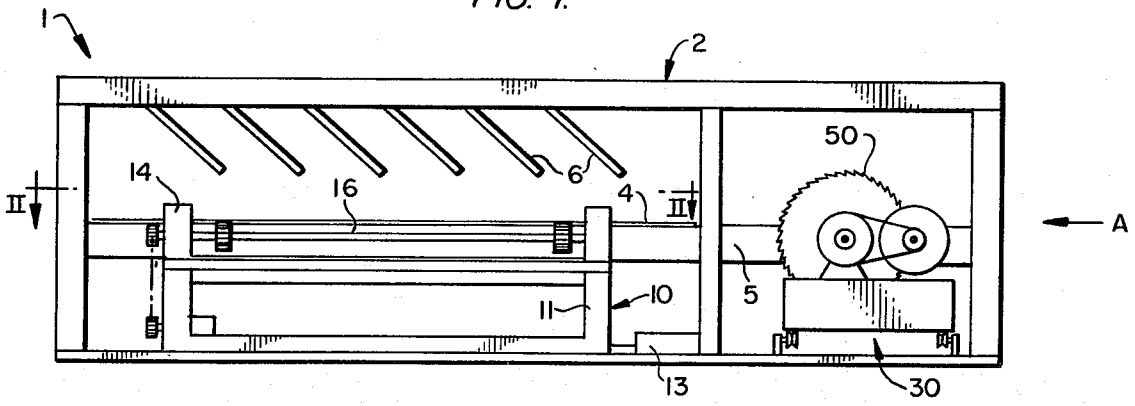
FIG. 1 is a side elevational view of a scragg mill in accordance with the present invention.
Figure 2:
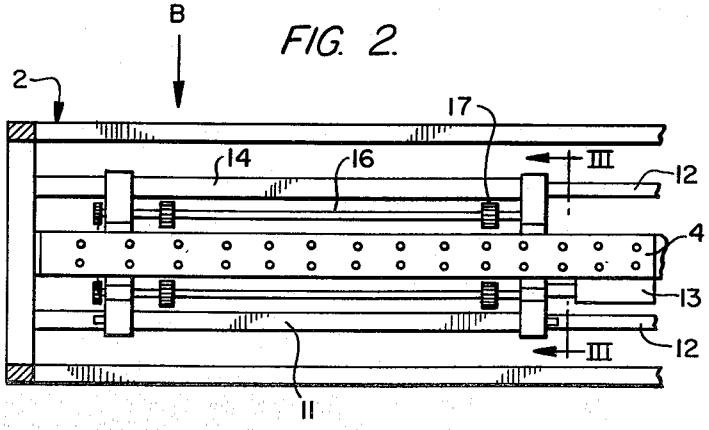
FIG. 2 is a partial plan view of the mill of FIG. 1, taken along line II—II of FIG. 1.

With reference to FIG. 1, a scragg mill 1 is shown, which comprises a rectangular, box-like framework of beams. Logs are delivered laterally (from the direction of B, FIG. 2) from an elevated supply of logs in a conventional manner, and are transported through the mill on a spiked-beam log carriage of a type known per se. This known log carriage utilizes a beam 4 of T-section that has log support means in the form of upwardly directed spikes extending therefrom. The T-section beam is received, for longitudinal displacement, between beam rails 5 of L-section (see FIG. 3), and the log is held on the spiked-beam 4 by conventional log clamping dogs 6 that are liftable and lowerable by pneumatic means carried by a carriage that is longitudinally displaceable along with the spiked beam 4, along the overhead beam 7 (FIG. 4) secured to the frame 2.

To the extent so far described, the illustrated mill is of known construction and it is also pointed out that, while the log carriage is shown terminating immediately downstream of the husk frame assembly 20, it should be recognized that the track, formed by beam rails 5, extends downstream of the husk frame assembly 30 for a distance similar to that which it extends upstream thereof, and, in this downstream location, is flanked by roller-type conveyors for transporting away of the boards cut from the logs passed through the mill. However, inasmuch as this downstream station is of known design and forms no part of applicants' invention per se, no detailed description or illustration thereof is believed necessary, it being merely sufficient to note that the beam 4 is reciprocated between the position shown in FIG. 1 and this downstream station by a suitable drive means (not shown). An example of one known mill which is commercially available and to which reference can be made is that sold by Frick Forrest Products Co., Inc., Waynesboro, Pa.

As previously noted, before passing a log through the parallel circular saw blades of a scragg mill, it is necessary to orient the logs so that any bowing thereof is disposed in a vertical plane. In order to achieve such, in accordance with the present invention, the scragg mill 1 is provided with a log turner indicated generally at 10.

Since all logs will not be of the same length, in order to center the log turner 10 relative to a given log, its base frame 11 is mounted on a pair of tracks 12 so as to be longitudinally adjustable parallel to the log and beam 4 upon which it rests, by action of a hydraulic piston and cylinder unit 13. The base frame 11 extends underneath the beam 4 and guide track rails 5, as does a lift frame 14. Lift frame 14 is pivotably mounted to base frame 11 by a pivot shaft 15 secured to the top of one side of the base frame 11. The lift frame 14 carries, at each side of the log carriage, a rotationally driven shaft 16 to which a pair of ribbed, live rollers 17 is secured. Lift frame 14 is caused to pivot in a manner raising the pairs of rollers 17 by a hydraulic jack device 18 or the like.

Figure 3:
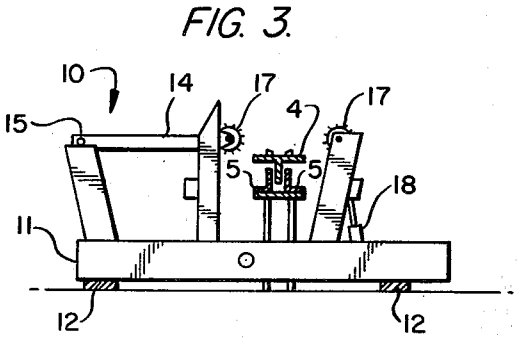
FIG. 3 is a partial sectional view of FIG. 2, taken along line III—III, illustrating the turn-over mechanism aspect of the present invention.

In use, a log is delivered in a conventional manner onto the log carriage, and the turning apparatus is then centered relative thereto. Hydraulic jack 18 is then actuated to raise the lift frame 14 so as to bring the rollers 17 into engagement with the log, raising same off of the log carriage. The raised position of the rollers 17 is shown in FIG. 3, and, in this position, the rollers 17 are caused to rotate so as to turn the log into a proper orientation with any bowing thereof situated in a vertical plane. Thereafter, the lift frame 14 is lowered so as to remove the log from the rollers 17, back onto the beam 4 of the log carriage. The pneumatically controlled clamping dogs 6, which are raised so as not to interfere with the turning operation, are then lowered back into engagement with the log which is then ready for conveyance into the blades of the mill.

Figure 4:
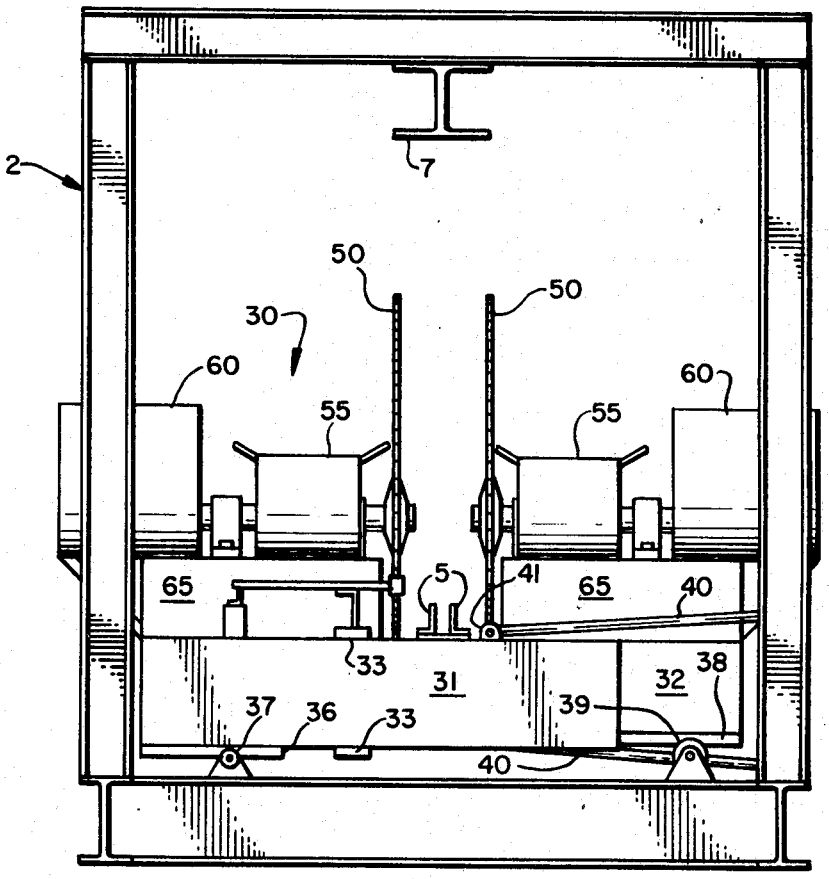
FIG. 4 is an elevational view of the mill of FIG. 1 viewed in the direction of arrow A.
Figure 5:
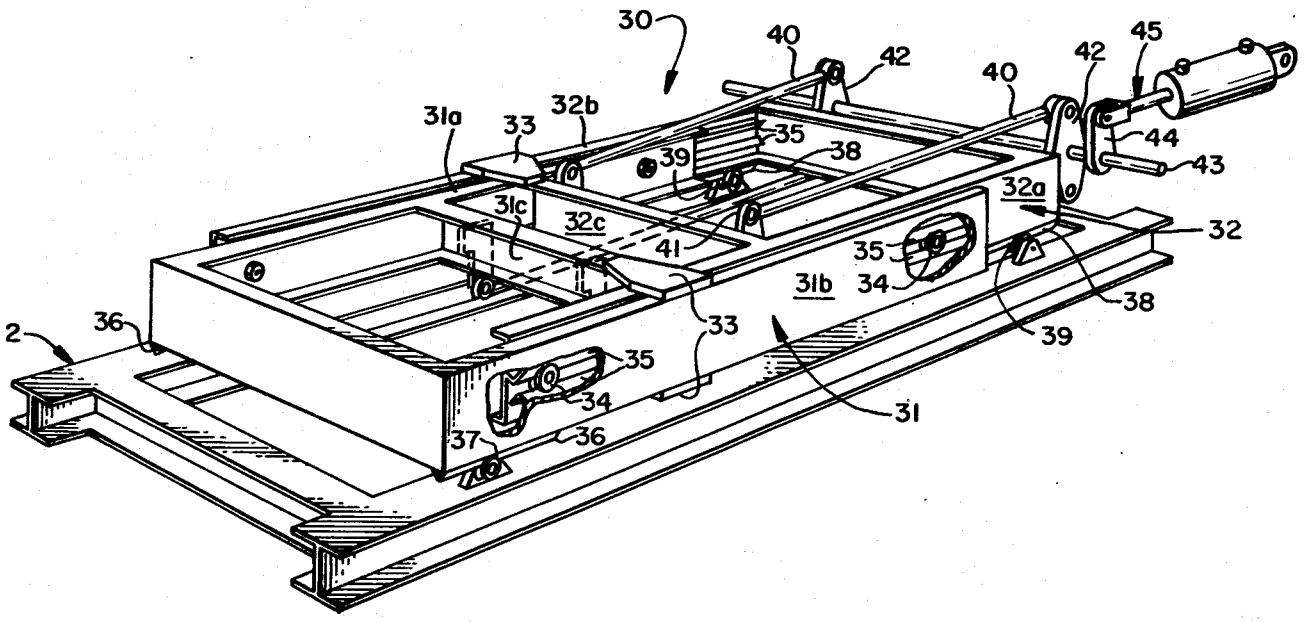
FIG. 5 is a perspective view of a husk frame assembly in accordance with the present invention.

With reference to FIGS. 4 and 5, the preferred husk frame assembly in accordance with the present invention will now be described. Husk frame assembly 30, which holds the saw blades 50 and their associated conveyors 55 and motors 60, is comprised of two interlocking husk frames 31 and 32. Husk frames 31 and 32 are generally A-shaped, having legs 31*a*, 31*b* and 32*a*, 32*b*, respectively, and inner cross-bridges 31*c* and 32*c*, respectively. The cross-bridges 31*c*, 32*c* do not completely span the distance between the legs 31*a*, 31*b* and 32*a*, 32*b*, respectively, but rather terminate short of the legs 31*b*, 32*b* ("b" legs) so as to create a gap between the free ends of the cross-bridges and the facing surfaces of the "b" legs; each such gap is spanned by respective connector plates 33 which are welded to the top and bottom of the cross-bridges 31*c*, 32*c* and "b" legs. In this manner, the two husk frames 31, 32 can be telescopingly interfitted with each other by insertion of the "a" leg (31*a* and 32*a*) through the gap between the cross-bridge and the "b" leg, underneath the upper connector plate 33 and over the lower plate 33 so that the "a" legs of husk frames 31, 32 constitute inner legs and the "b" legs constitute outer legs.

In order to provide a highly stable interlocking relationship between the husk frames 31, 32, V-grooved rollers are rotatably connected on the outer face of the "a" legs and oppositely directed V-tracks welded along the inner surface of the "b" legs, so that the rollers 34 can be received between the V-tracks 35, with these tracks positioned in their V-groove.

In order to facilitate relative movement between the husk frames 31, 32 and the mill frame 2, the under side of the legs 31*a*, 31*b* of husk frame 31 are provided with V-tracks 36 which are carried upon rotatably journaled rollers 37 mounted upon parallel bottom beams of frame 2, and husk frame 32 is similarly provided with V-tracks 38 on the under sides of its legs 32*a*, 32*b*, that are guided within the groove of V-grooved rollers 39, which are rotatably journaled to brackets mounted on the frame 2.

In order to effectuate simultaneous and equal displacement of the husk frames 31, 32 relative to the log carriage, a hydraulic piston and cylinder unit actuated lever linkage arrangement is provided. More particularly, rods 40 are pivotably connected at one end to L-brackets 41 which are secured to a facing wall of cross-bridge 32*c* of husk frame 32, and, at an opposite end, are pivotably connected to link plate 42. Similar rods 40 are connected at one end to an opposite, lower end of link plate 42 and extend below husk frame 32 to an opposite end thereof, which is pivotably connected to downwardly-directed L-brackets (which are constructed in the same manner as brackets 41, but are not shown) on the facing surface of cross-bridge 31*c*. Both of the link plates 42 are fixedly mounted to a rocker shaft 42, as is a rocker plate 44. Rocker plate 44 is pivotably connected to a yoke of a hydraulic piston and cylinder unit 45.

For adjusting the husk frame, if the piston of hydraulic piston and cylinder unit 45 is retracted, rocker plate 44 will cause the shaft 43 to rotate clockwise (with reference to FIG. 5, thereby shifting husk frame 31 to the left, and husk frame 32 to the right (also with reference to FIG. 5) while the opposite movements will be achieved upon extension of the piston of piston and cylinder unit 45. As a result, a single hydraulic cylinder is able to simultaneously shift the husk frames 31, 32 toward and away from each other by an equal distance relative to the log carriage; in this regard, it is noted that log carriage 5 passes over the husk frame assembly 30 with clearance (as shown in FIG. 4) so as not to interfere with adjustment of assembly 30. It is also pointed out that the husk frame is sized, and the upper rods 40 spaced apart, to a degree sufficient to enable a saw unit composed of a circular blade 50, conveyor 55, drive unit 60, and sub-frame 65 to be positioned, on frame 32, between the upper rods 40 so as to be free of interference therewith.

The above-noted construction of the husk frame assembly 30 provides for great stability for each individual husk frame due to its interlocked construction, while the hydraulic piston and cylinder unit and linkage arrangement not only enables a single hydraulic piston and cylinder unit to accurately and easily displace the saw blades 50 with respect to each other, but also is able to provide an absolutely positive holding of the saws in the position adjusted to, that is superior to that obtainable by any known husk frame assembly of the prior art.

While we have shown and described only a single embodiment in accordance with the present invention, it is understood that the same is not limited thereto but is susceptible of numerous changes and modifications as would be known to those skilled in the art, given the present disclosure, we therefore do not wish to be limited to the details shown and described herein but intend to cover all such changes and modifications as are encompassed by the scope of the appended claims.

For example, it is known to equip skragg saw mills with various types of cutting heads other than rotary saw blades. Therefore, since the husk frame assembly of the present invention is suitable for use with pairs of cutting heads other than the described rotary blades, the description of saw blades in the present application should be construed as including all types of cutting heads as are conventionally used in mills of the type disclosed herein.

We claim:

1. A scragg saw mill comprising:

(a) a pair of saw blades and means for rotationally driving same;

(b) a log carriage means for conveying a log between said saw blades; and (c) a husk frame assembly for supporting said saw blades and the means for driving same and for shifting both of said saw blades laterally with respect to each other and said log carriage means in a manner adjusting the distance between each blade and the log carriage means by an equal amount;

wherein said husk frame assembly comprises a pair of husk frames in telescopingly interlocked relationship with each other and means for adjusting the telescopingly interlocked relationship of the husk frames for producing said shifting of the saw blades, each of said blades and the means for driving same being mounted upon a respective one of said husk frames.

2. A scragg saw mill according to claim 1, wherein each of said husk frames have a pair of arms which are slidingly engaged with the arms of the other of the husk frames.

3. A scragg saw mill according to claim 2, wherein the pair of arms of the husk frames comprise an inner arm and an outer arm, the inner arm of each husk frame being slidably interconnected to an inner side of the outer arm of the other husk frame.

4. A scragg saw mill according to claim 3, wherein the slidable interconnection between the inner and outer arms of the husk frames is formed by a pair of oppositely directed V-shaped tracks on one of the arms and V-grooved rollers on the other of the arms, the V-grooved rollers being received between said V-shaped tracks in engagement therewith.

5. A scragg saw mill according to claim 4, wherein an underside of each of the arms of the husk frames is provided with V-shaped support tracks, said husk frames being displaceably supported for movement relative to said log carriage means upon V-grooved support rollers by engagement of the support tracks in the V-groove thereof.

6. A scragg saw mill according to claim 4, wherein the husk frames are generally A-shaped, said arms being formed by legs of the A-shape, and wherein the inner arms extend through a gap between a cross-bridge of the A-shape and the outer arm.

7. A scragg saw mill according to claim 2, wherein an underside of each of the arms of the husk frames is provided with V-shaped support tracks, said husk frames being displaceably supported for movement relative to said log carriage means upon V-grooved support rollers by engagement of the support tracks in the V-groove thereof.

8. A scragg saw mill according to claim 3, wherein the husk frames are generally A-shaped, said arms being formed by legs of the A-shape, and wherein the inner arms extend through a gap between a cross-bridge of the A-shape and the outer arm.

9. A scragg saw mill according to any one of claims 1–8, wherein said means for adjusting comprises a hydraulic piston and cylinder unit and a lever linkage arrangement connected between the husk frames and the piston and cylinder unit.

10. A scragg saw mill according to claim 9, wherein the linkage arrangement comprises a pair of rods pivotably connected at respective ends between each husk frame and a respective end of a link plate secured to a rocker shaft, the piston of the piston and cylinder unit being pivotally connected to a rocker arm secured to the rocker shaft.

11. A scragg saw mill comprising:

(a) a pair of saw blades;

(b) a log carriage means for conveying a log between said saw blades having log support means upon which the log is carried; and (c) a husk frame assembly for supporting said saw blades and for shifting said saw blades laterally with respect to each other in a manner adjusting the distance between each blade and the log carriage means;

further comprising a log turner located upstream of said saw blades in a direction of log feed, said log turner having a base frame, a lift frame pivotally connected to said base frame, a pair of rotatably driven rollers carried by said lift frame at each of opposite sides of the log carriage means, and means for pivoting said lift frame about the pivotal connection to the base frame so as to raise and lower said pairs of rollers between a lowered, inactive position located below the log support means of the log carriage means and a raised, log supporting and turning position located above the height of the log support means of the log carriage means, wherein the log is lifted off said log support means and supported upon said roller pairs for turning.

12. A scragg saw mill according to claim 11, wherein said base frame is supported on tracks for displacement of the turner parallel to said log carriage means in order to enable longitudinal centering of said pairs of roller relative to a log on said log carriage means, and wherein drive means is provided for displacing the log turner along said tracks.

* * * * *